United States Patent [19]

Hovis

[11] 4,083,677

[45] Apr. 11, 1978

[54] METHOD AND APPARATUS FOR HEATING A FURNACE CHAMBER

[75] Inventor: James E. Hovis, Pittsburgh, Pa.

[73] Assignee: Bloom Engineering Company, Inc., Pittsburgh, Pa.

[21] Appl. No.: 725,563

[22] Filed: Sep. 22, 1976

[51] Int. Cl.[2] ..... F23N 1/02; F27D 7/00

[52] U.S. Cl. ..... 432/19; 432/25; 432/52; 266/96; 431/90

[58] Field of Search ..... 432/9, 12, 19, 20, 25, 432/52, 176, 196, 175, 21, 145; 236/1 E, 1 A; 431/1, 89, 90; 266/96, 261

[56] References Cited

U.S. PATENT DOCUMENTS

| | | | |
|---|---|---|---|
| 3,172,647 | 3/1965 | Remmey | 432/145 |
| 3,583,691 | 6/1971 | Twine | 432/175 |
| 3,689,041 | 9/1972 | Pere et al. | 432/12 |
| 3,721,728 | 3/1973 | Luetzelschwab | 432/25 |
| 3,795,478 | 3/1974 | Knaak | 432/25 |
| 3,887,326 | 6/1975 | Townley | 432/25 |
| 3,969,069 | 7/1976 | Knaak | 432/9 |

*Primary Examiner*—John J. Camby

*Assistant Examiner*—Henry C. Yuen

*Attorney, Agent, or Firm*—Webb, Burden, Robinson & Webb

[57] ABSTRACT

The method for heating the furnace chamber produces high momentum levels during the heat treating cycle so as to obtain substantially uniform temperature throughout the charge. The method includes initially firing a plurality of high velocity burners at substantially maximum fuel input and in substantially stoichiometric ratio. Thereafter, the fuel input is reduced while maintaining the stoichiometric ratio at least during the high input portion of the cycle. Excess air is introduced external of the combustion zones of the burners on a predetermined signal such as a given fuel input reduction to maintain the desired momentum level within the furnace. The apparatus comprises a high velocity burner having associated therewith an excess air unit for discharging excess air external of the combustion chamber or port block of the burner. The excess air unit can be integral with the burner so as to supply excess air through the burner port block or a separate unit can be provided which is connectable to the burner and about the port block which defines the combustion chamber.

9 Claims, 8 Drawing Figures

METHOD AND APPARATUS FOR HEATING A FURNACE CHAMBER

FIELD OF THE INVENTION

My invention relates to method and apparatus for heat treating furnaces and, more particularly, to a method and apparatus for maintaining high momentum levels in a furnace chamber throughout the heat treating cycle so as to obtain substantially uniform temperature throughout the furnace charge while firing in stoichiometric ratio throughout at least the high input portion of the cycle to assure minimal energy consumption.

DESCRIPTION OF THE PRIOR ART

A heat treating cycle in a metallurgical furnace is dependent upon the particular metallurgical requirements for the charge being treated. In practically all cases there is a need for close temperature uniformity near the end of the soaking portion of the heat treating cycle. This degree of uniformity is often difficult to achieve in practice or, if achieved, is often too costly in view of the present energy shortage and resultant increased costs of fuel. The typical metallurgical heat treating furnace has door seals, cracks, sand seals, etc., all of which are subject to leakage unless a positive pressure is maintained within the chamber. These leaks permit cold air to enter thereby causing a localized cold area on the charge. Any furnace structure and pressure control system designed to assure absolute maintenance of positive pressure at minimum input level (10–100/1 turndown) would be due to the complicated design and resultant cost. Equally, the furnace door usually has a higher heat loss than the side walls and this also leads to localized cold areas of the charge adjacent the furnace door. Various arrangements of control zones have been utilized to minimize localized high loss areas such as doors.

It is known that maintaining a high degree of recirculation in a furnace chamber is a major factor in obtaining close temperature uniformity of the charge. It is also known that the degree of recirculation is directly related to the momentum of the gases entering the chamber. One way to maintain a high momentum within the furnace chamber is to set a constant high air flow level in the furnace sufficient to accommodate a maximum firing rate. Thereafter, as the charge heats up to its soaking temperature, the fuel input is reduced while leaving the high air input level constant. This method of heating a chamber eliminates the problem of furnace leaks, etc. because of the large volume of air being discharged into the furnace. However, such a system is not efficient since large amounts of fuel must be used up to heat the tremendous quantities of excess air entering the furnace chamber. With the present energy shortage, coupled with extremely high fuel costs, this system is not economically reasonable nor responsive to the energy shortage.

An optimum system from the standpoint of fuel conservation for operating a furnace is the so-called ratio fired system. In a ratio fired system, the input air is continually reduced as the fuel input is reduced so that in essence there is little, if any, excess air and the burner is operated in complete stoichiometric ratio of combustion air to fuel, thus assuring maximum efficiency. The problem with this system is threefold.

First, as the fuel and air are turned down, there is virtually no energy going into the furnace chamber to provide the necessary recirculation from the standpoint of uniformity. This turndown may even be in the range of 100:1 for certain applications. Therefore, in the most critical part of the heat treat cycle where uniformity is needed, the degree of uniformity has often deteriorated to the point where unsatisfactory metallurgical results occur.

Secondly, ratio firing gives maximum flame temperature and a resultant localized high temperature area at each burner. This localized high temperature leads to localized hot spots or overheated areas on the product.

A third disadvantage of using a plurality of ratio fired burners results from the necessary reliance on radiation to obtain heat transfer. In other words, at low energy inputs into the furnace there is little, if any, convective heat transfer which then means extremely long equalization times for the charge within the furnace. This is particularly critical, for example, with a charge consisting of a substantial number of round bars or tubes spaced apart vertically. With little convective heat transfer, it is necessary to get the top or bottom bar up to temperature and let it reradiate to the adjacent bars, etc; thus, the very long equalization times.

SUMMARY OF THE INVENTION

It is an object of my invention to adopt only the advantages of the foregoing extremes into a single system, that is, a system which optimizes fuel conservation and also provides maximum uniformity through the maintenance of high momentum and moderate flame temperature within the furnace chamber.

My method of heating a furnace chamber includes firing a plurality of high velocity burners at substantially maximum fuel input and in substantially stoichiometric ratio. As the charge approaches the desired soaking temperature, I thereafter reduce the fuel input and the combustion air input so as to maintain the stoichiometric ratio. At a predetermined signal such as a given fuel reduction, I introduce high velocity excess air external of the combustion zones of the burners so as to (1) maintain the desired energy input into the furnace chamber, and to (2) temper or substantially reduce flame temperature. This latter point is achieved through the high momentum level of excess air jets which induce recirculation of (1) high temperature flame or combustion gas into the lower temperature excess air, and (2) lower temperature furnace gases into the high temperature flame or combustion gas at its entrance to the furnace. The apparatus may be an integral part of the burner so as to provide excess air ducts through the port block or the apparatus can be simply a small capacity burner fired in ratio with an excess air unit attached thereto so as to provide high velocity excess air during the soaking portion of the heat treating cycle. The excess air ports air ports are normally spaced radially outward from the central axis of the burner and combustion chamber.

DESCRIPTION OF THE PREFERRED EMBODIMENTS

Figure 1:
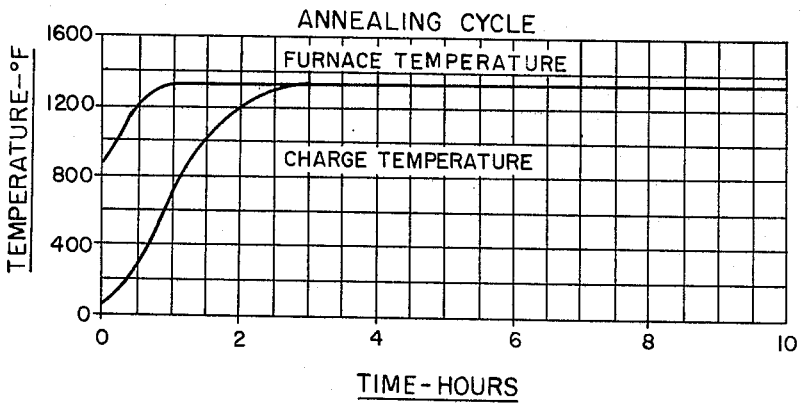
FIG. 1 is a graph showing a typical heat treating cycle for a metallurgical furnace.

A simple heat treat cycle for a metallurgical furnace includes a heating cycle followed by a soaking cycle. Specifically, a charge is placed in the furnace at some convenient, nondetrimental temperature and thereafter the furnace is fired through a plurality of burners operating at maximum output to achieve a desired furnace temperature. Because of the mass of the charge, the charge temperature lags behind the furnace temperature during the heating cycle. As the charge approaches the desired furnace temperature, the burners are gradually turned down to the level required. FIG. 1 illustrates such a cycle for a car type annealing furnace. My method of heating a furnace chamber is described hereinafter in conjunction with that cycle, although it will be recognized that my method is equally applicable to other more complex cycles. Further, while my invention is described in relation to a metallurgical heat treating furnace, it will also be recognized that it is applicable to many other types of furnaces and charges.

One previously described prior art method of maintaining a constantly high air flow into the furnace is referred to hereinafter as the tempered flame system. In the tempered flame system the air input is set equal to or higher than stoichiometric for maximum fuel input and is maintained constant throughout the cycle. Momentum and the cooling of the flame is achieved by the large quantities of excess air maintained. The fuel consumption for a tempered flame cycle of FIG. 1 is shown by the dot-dash lines in FIG. 2. As the charge temperature approaches the furnace temperature and internal uniformity, the burners are turned down in stages until the only heat input is that necessary to compensate for heat losses in the furnace. Because of the constant high air input throughout the cycle, a substantial amount of fuel must be consumed to maintain the temperature of the excess air entering the furnace. For the cycle illustrated with natural gas as the fuel, 52,000,000 Btu's represent the total fuel input for the tempered flame system.

Figure 2:
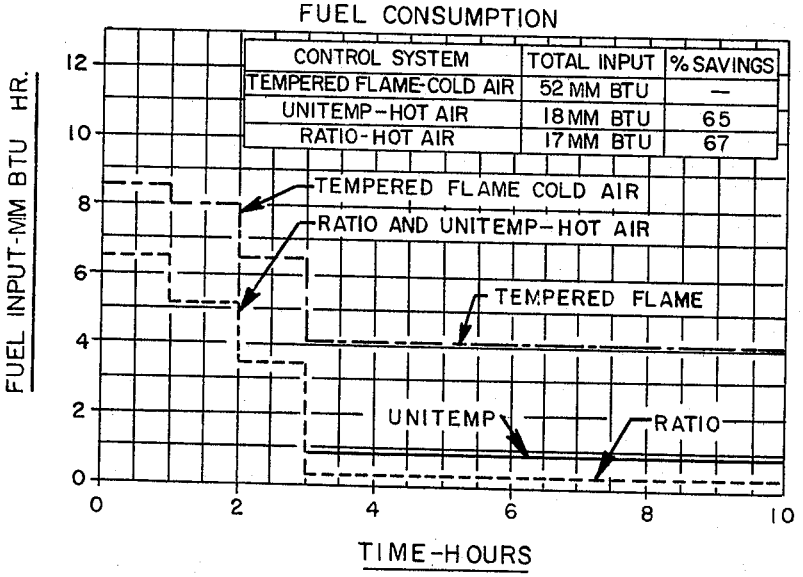
FIG. 2 is a chart showing total fuel consumption for my invention as compared to the prior art.

On the other end of the spectrum is the ratio fired burner system illustrated by the dotted lines in FIG. 2. In the ratio fired system the burner fuel input is also turned down as the charge temperature approaches the soaking cycle. Simultaneously with turning down the fuel input the air input is likewise reduced so that the fuel to air ratio remains substantially stoichiometric. It can be seen that for the same heat treating cycle, the ratio fired system utilized approximately 17,000,000 Btu's of natural gas. This represents a fuel savings of approximately 67% against the tempered flame system, but the disadvantages set forth hereinabove relative to poor circulation and hot and cold spots within the furnace are ever present.

In my system, the plurality of burners are fired at maximum fuel input during initial stages of the cycle as in the other two systems. Thereafter, the fuel input is reduced while at the same time, the air for combustion is reduced so as to keep the burners firing in substantially stoichiometric ratio. Up to this point in the cycle, my method is similar to the ratio fired system. However, at a predetermined signal, excess air is introduced into the furnace at high velocity and external of the combustion air being provided to the burner. Thereafter, the combustion air can be reduced in ratio with the fuel or can be operated at a constant level as in the tempered flame mode to assist in cooling the flame. In the particular example illustrated in FIG. 2, the high velocity excess air is introduced into the furnace when the fuel input reduction reaches 25% of the maximum input. The total fuel input of 18,000,000 Btu's represents a fuel savings of 65% over the tempered flame system and is only slightly more fuel than used in the ratio fired system.

Figure 8:
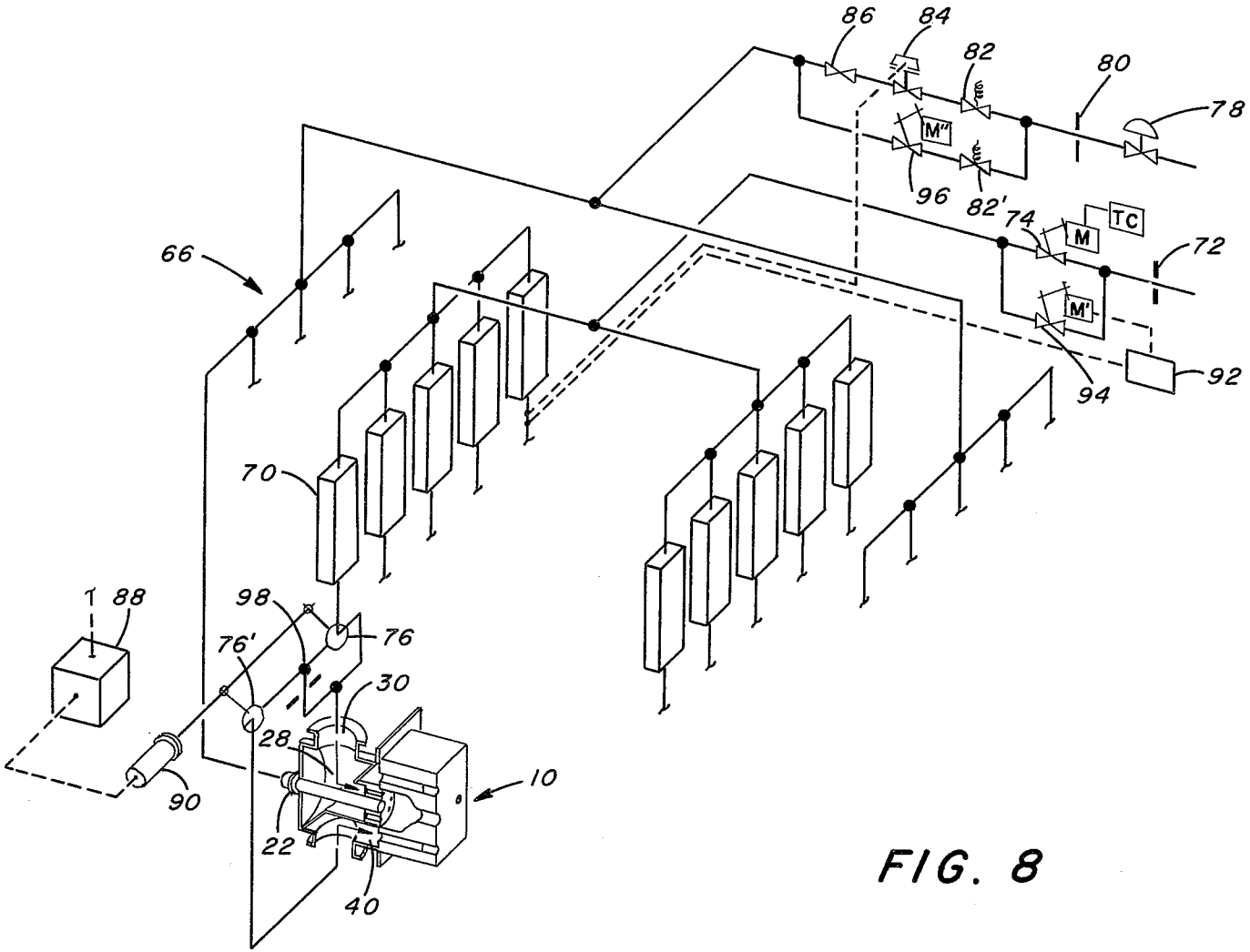
FIG. 8 is a diagrammatic representation of a control system for carrying out my heat treating cycle.

The particular signal at which the high velocity excess air is introduced can be based on a number of conditions other than fuel turndown. For example, the excess air can just as easily be triggered by a temperature or a time signal. A fuel turndown signal control system is illustrated in FIG. 8 and is described hereinafter.

Figure 3:
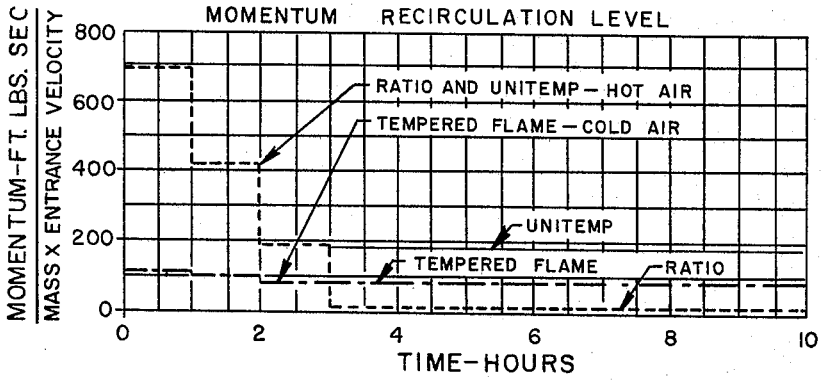
FIG. 3 is a graph showing the momentum and recirculation of my invention as compared to the prior art.

It can be seen in FIG. 3 that the total momentum which establishes the recirculation within the furnace chamber is substantially higher for the subject invention (referred to as Unitemp) as compared to either the tempered flame system or the ratio fired system, FIG. 3. The data from FIG. 3 is summarized in the following Table 1 wherein the total momentum has also been calculated for supplying the excess air through a high velocity burner as opposed to external of the burner as in the subject invention.

TABLE 1

Momentum Level Comparisons
Car Type Furnace

| System | Momentum ft. lb./sec. During Soak |
|---|---|
| 25% excess air external of hi vel. burner | 175 |
| Tempered flame low vel. burner (100% excess air) | 84 |
| 25% excess air through hi vel. burner | 72 |
| Ratio fired hi vel. burner | 1 |

The degree of recirculation within the chamber is directly related to the momentum of the gases entering the chamber whether combusted gases, flames, or excess air. The momentum values reported hereinabove may be termed as "instantaneous" momentum in that the values are based on the mass flow rate into the chamber times the velocity at entrance.

A substantial advantage results from providing the excess air external of the high velocity burners as compared to directing it through the combustion chamber of the high velocity burner, compare the 175 ft. lbs./sec. to the 72 ft. lbs./sec., respectively in Table 1. This advantage results from the fact that the excess air supplied external of the furnace can be introduced at extremely high levels by using high pressure drops across the entrance nozzle. The data presented in Table 1 was developed through the use of a 20 inch W.C. excess air pressure which gives approximately 445 ft./sec. air velocity. This compares with an exit port velocity of only 30 ft./sec. if the excess air is injected through a high velocity ratio fired burner.

Aside from the degree of recirculation and momentum, another factor that affects temperature uniformity is the total weight of the products being introduced into the chamber and the drop in the temperature of the products as the heat is lost to the chamber in supply of heat losses. Since the tempered flame system has maximum weight of products throughout the cycle and in the example cited, the ratio fired and the system of the subject invention dropped to 25% of the flow rate during the soak cycle, the theoretical temperature difference in the latter two instances will, of course, be four times that of the tempered flame system. In my system I overcome the high theoretical temperature drop with substantially higher rates of recirculation. This substantial mixing of the excess air and the furnace gases assures a minimum temperature difference.

A typical heat treating furnace has a plurality of burners. For example, the car type furnace illustrated in FIGS. 1–3 was fired with 38 burners positioned in parallel banks along the bottom of the furnace. These burners are positioned every four feet and with natural gas as the fuel produce a flame temperature of 3700° F. In my system, this flame is effectively cooled so as to eliminate hot spots in the areas adjacent the burners. The high velocity external excess air jets create a negative pressure about the port openings of the burners which then draw the furnace gases into intimate contact with the flame. The combination of exiting excess air (e.g. preheated to 700° F) and the furnace gases cool the exiting flame.

Figure 5:
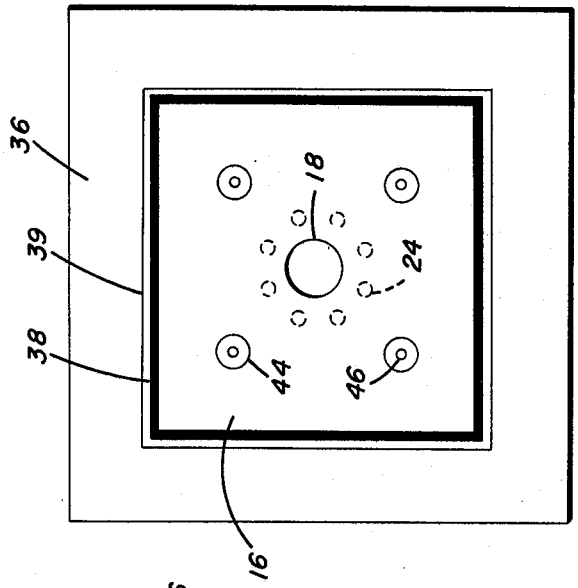
FIG. 5 is a side elevation of the burner of FIG. 4.
Figure 4:
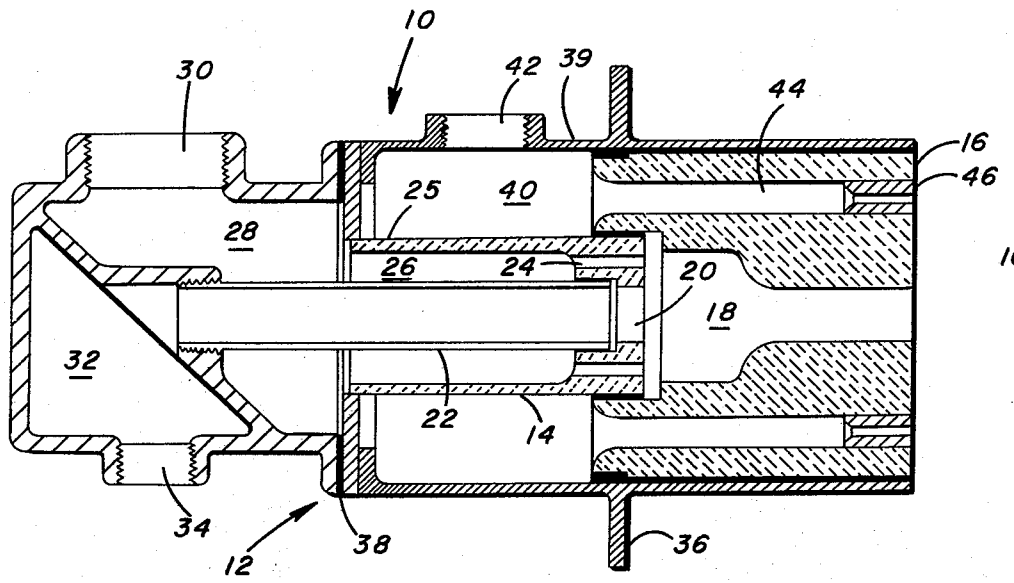
FIG. 4 is a section through a burner apparatus of my invention.

Several burner and excess air unit designs can be utilized to achieve the high momentum rates necessary to practice my method of heating a furnace chamber. One such burner and excess air apparatus, generally designated 10, is illustrated in FIGS. 4 and 5. A burner body 12 has attached to it an outer annular wall 39 which includes an annular mounting plate 36 for attachment to a furnace chamber (not shown). Communicating with the downstream end of the burner body 12 and mounted within the outer wall 39 is a refractory port block 16 which defines a combustion chamber 18 which extends along the burner body central axis. Upstream of the combustion chamber and within the outer wall 39 is a refractory baffle 14. Refractory baffle 14, which could of course be metal, includes a central fuel opening 20 in registry with combustion chamber 18 and a plurality (eight) of combustion air apertures 24 (straight or skewed) extending through the baffle 14 so as to also be in registry with combustion chamber 18. The apertures 24 are spaced radially outward from the fuel opening and in circular relationship thereto.

The baffle 14 includes a rearwardly extending annular wall 25 which defines a combustion air chamber 26 which is concentrically positioned about a central fuel duct 22. Fuel duct 22 terminates within the fuel opening 20 and communicates at its other end with a fuel chamber 32 within the burner body 12. Fuel chamber 32 includes an inlet 34 for attachment to a fuel source such as natural gas.

Likewise combustion air chamber 26 communicates with an upstream combustion air chamber 28 formed in the rear of the burner body 12. Combustion air chamber 28 includes an air inlet 30 for attachment with an air or other combustion sustaining gas source. The various elements of the burner and excess air apparatus 10 that are not integrally formed are maintained in gas tight relationship by appropriate gaskets 38 positioned where necessary throughout the apparatus 10.

Positioned concentrically about the baffle extension wall 25 is the annular wall 39 which defines annular excess air chamber 40 therebetween. Excess air chamber 40 includes an inlet 42 for communication with an excess air source, preferably to supply preheated air from a recuperator to the apparatus 10. Extending through the port block 16 and communicating the excess air chamber 40 with the furnace chamber (not shown) is a plurality (four) of excess air ducts 44, FIG. 5. The excess air ducts 44 extend radially outward from and in circuit relation to the burner central axis and combustion chamber 18. Inserted within the downstream end of excess air ducts 44 are appropriate restrictive nozzles 46 to provide the high port velocities to the excess air exiting therefrom.

Figure 7:
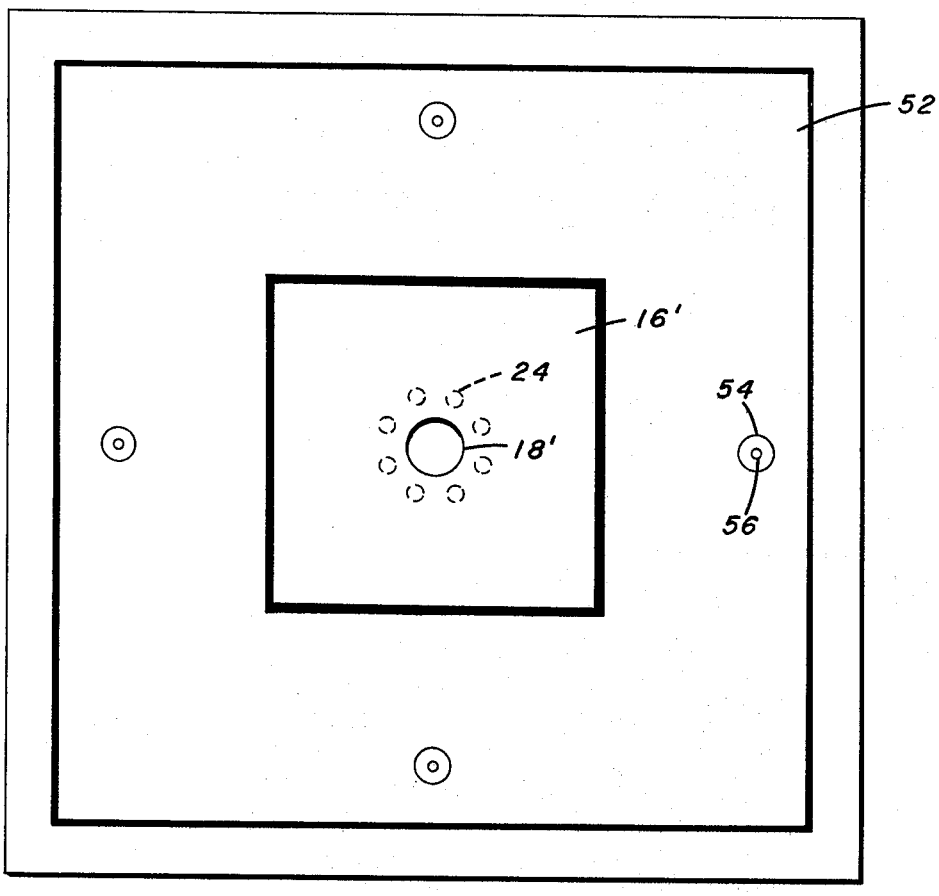
FIG. 7 is a side elevation of the burner of FIG. 6.
Figure 6:
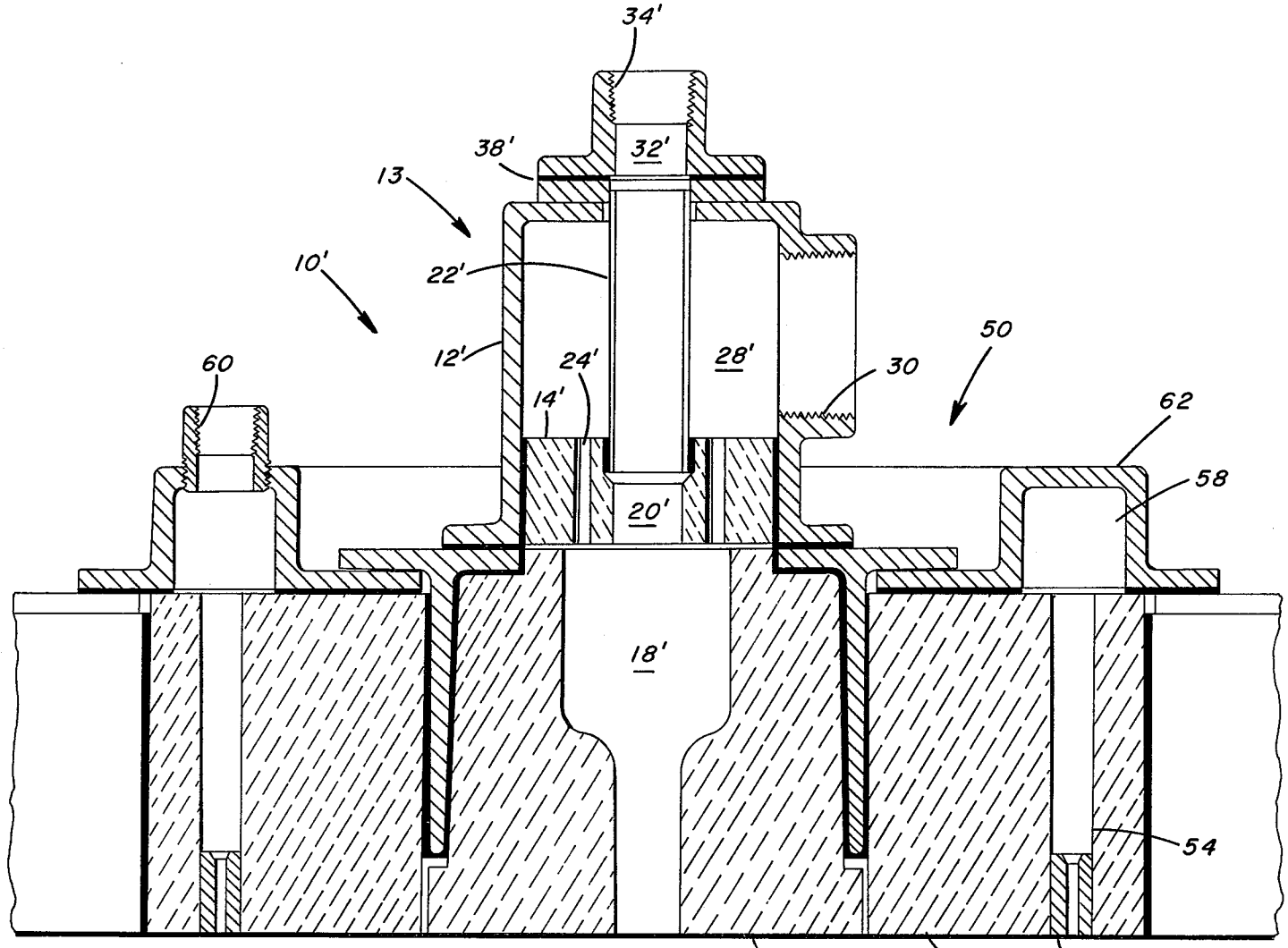
FIG. 6 is a section through another embodiment of my burner apparatus.

A separate excess air unit, generally designated 50, can be joined to and used in combination with a standard burner 13, FIGS. 6 and 7. The burner 13 is a high velocity burner having a burner body 12', the downstream portion of which is closed off by a refractory baffle 14'. Baffle 14' includes a plurality (eight) of combustion air apertures 24' extending therethrough in communication with combustion chamber 18' and port block 16'. As in the earlier embodiment, the apertures 24' can be straight, diverging, converging, skewed, etc. as presently known in the art. The combustion air apertures 24' are positioned in circular relationship and radially outward from the central axis of the burner 13 and about a central fuel opening 20' also in communication with the combustion chamber 18'. A fuel duct 22' extends along the central axis of the burner 13 and terminates at one end within the fuel opening 20' and at the other end in a small fuel chamber 32' which includes an inlet 34' for attachment to a proper fuel source. The burner body 12' defines a combustion air chamber 28' about the central fuel duct 22' and upstream of baffle 14'. Chamber 28' terminates at an inlet 30' for attachment to the proper combustion air source.

The unit 50 includes a large annular refractory baffle 52 which is positioned about the port block 16'. Upstream of the annular baffle 52 is an annular excess air chamber 58 formed by concentric walls 62 which connect to the burner body 12' and the baffle 52. Chamber 58 includes an inlet 60 for attachment to a suitable excess air source.

Extending through the annular baffle 52 is a plurality (four) of excess air ducts 54 in registry with the excess air chamber 58 and the furnace chamber (not shown). Ducts 54 are positioned in a circular array and radially spaced from the combustion chamber 18'. Positioned in the downstream end of ducts 54 are restrictive nozzles 56 to impart a high port velocity to the excess air exiting therefrom.

Both of the above burners operate independent of the excess air portion although the excess air can be triggered by a given variable within the burner such as a given fuel reduction. A control system 66 for operating burners of the type illustrated in FIGS. 4 and 5 is illustrated in FIG. 8. Such a system can also be used for the burners of FIGS. 6 and 7.

The control system 66 is described for two parallel banks of burners 10 (only one is shown) with five burners in each bank. The ambient air is preheated through recuperators 70 and the main control system is common to all burners. Separate three way valves 76 and 76' are provided for each burner as described hereinafter.

At the start of the cycle the burner 10 is fired in ratio at high output. The basic control for high output is a preset furnace temperature control. T.C. which controls motor M and the high flow air control 74. The ambient air passes through a zone air orifice 72 and high flow air control 74 into an appropriate recuperator 70. From recuperator 70 the now preheated air passes through three way valve 76 and into chamber 28 within burner 10. At the same time the fuel (gas) is kept in ratio with the air by the high flow fuel air ratio control pressure balance and ratio regulator 84. Specifically, the gas initially passes through a gas pressure regulator 78 and zone gas orifice 80 before entering regulator 84. Regulator 84, a standard item, balances the gas flow with the air flow so as to keep the two in ratio. Throttle valve 86 is the manuel set for regulator 84 and is only used in the initial setting of the fuel to air ratio. The gas flow continues into duct 22 of burner 10. In other words, if the temperature control in the furnace calls for less input, the high flow air is cut back in response thereto and the fuel is thereafter balanced against the reduced air input to keep the burner 10 firing in ratio.

The gas input through the zone gas orifice 80 is monitored by the fuel signaller 88. At a present reduction in fuel input, the signaller 88 activates excess air valve actuator 90 which in turn shuts off three way valve 76 and turns on three way valve 76'. Likewise, the high flow air control 74 and the high flow fuel air ratio control pressure balance and ratio regulator 84 are turned off through a contact in motor M and the shutoff solenoid 82, respectively.

The result is that the ambient air, after passing through zone orifice 72, is directed by valve 94 and its motor M' and is controlled by the low input air pressure controller 92 which maintains the necessary pressure. The dotted lines in FIG. 8 represent the pressure impulse lines to the pressure regulator 92, controller 94 and fuel signaller 88. The excess and combustion air then passes through the recuperator. The preheated air then passes through the combustion air orifice 98 into combustion chamber 30 of burner 10 and through three way valve 76' into the excess air chamber 40. The pressure controller 92 in conjunction with the zone orifice 98 maintains the desired pressure for both the combustion and excess air.

The gas during low input is directed through low flow gas control 96 which is operated by motor M'' from a furnace temperature control. The gas then proceeds into fuel duct 22 in the burner 10. It can, therefore, be seen that during the ratio firing high combustion air input, the air pressure control 92 and low flow gas control 96 are completely off and during the excess air-low input cycle, the high flow air control 74 and the pressure balance regulator 84 are completely off.

As illustrated, when the excess air is operating, the gas flow is not dependent on the combustion air so that the burner operates in a tempered flame burner mode thereafter. The system can be controlled to continue ratio firing even after the external excess air is activated. Further, the system can be operated with or without preheated air through recuperators.

I claim:

1. A method of heating a metallurgical furnace chamber or the like to maintain high momentum levels during a heat treating cycle so as to obtain a substantially uniform temperature throughout a charge positioned within the chamber comprising the steps for:

A. firing a plurality of high velocity burners by introducing fuel and combustion air through combustion zones of said burners at a high fuel input rate and substantially in the stoichiometric ratio;

B. reducing the fuel input rate while maintaining the stoichiometric ratio as a charge temperature approaches a heat treat temperature; and C. introducing excess air external of the combustion zones of said high velocity burners to maintain a desired momentum level within the furnace chamber during the remainder of the heat treat cycle.

2. The method of claim 1 wherein the fuel input ratio is reduced as the charge temperature approaches a furnace temperature.

3. The method of claim 1 wherein the step for introducing excess air commences at a given reduction in fuel input rate.

4. The method of claim 3 wherein the given reduction in fuel input rate comprises approximately 25% of the high fuel input rate.

5. The method of claim 1 wherein the step for introducing excess air commences at a given temperature of the charge.

6. The method of claim 1 including the step of maintaining the stoichiometric ratio after introducing the excess air for the remainder of the heat treat cycle.

7. The method of claim 1 including the step of maintaining the combustion air constant once the excess air is introduced while reducing the fuel during the remainder of the heat treat cycle.

8. The method of claim 1 including the step of preheating the excess air prior to introducing it external of the combustion zones.

9. A method of heating a furnace chamber to maintain high momentum levels during a heat treating cycle so as to obtain a substantially uniform temperature throughout a charge positioned within the chamber comprising the steps for:

A. firing a plurality of high velocity burners in response to a furnace temperature control signal by introducing fuel and combustion air through combustion zones said burners at a high fuel input rate and substantially in the stoichiometric ratio, said fuel being kept in ratio by pressure balancing against said combustion air;

B. reducing the combustion air while maintaining the stoichiometric ratio by pressure balancing the fuel thereagainst;

C. introducing excess air external of the combustion zones of said high velocity burners at a predetermined fuel reduction level while simultaneously terminating the pressure balancing; and D. maintaining substantially constant the combustion air level after introducing excess air while reducing the fuel input in response to a furnace temperature control signal.

* * * * *